United States Patent [19]

Wheelock

[11] Patent Number: 4,704,750

[45] Date of Patent: Nov. 10, 1987

[54] ASSEMBLEABLE, FREE-STANDING, BED SUSPENSION APPARATUS

[76] Inventor: Barry E. Wheelock, 2 White Birch Dr., Morris Plains, N.J. 07950

[21] Appl. No.: 883,305

[22] Filed: Jul. 7, 1986

[51] Int. Cl.[4] ..... A45F 3/22; A45F 3/24

[52] U.S. Cl. ..... 5/127; 5/120; 5/200 R

[58] Field of Search ..... 5/127, 128, 129, 130, 5/120, 122, 123, 200 R, 200 B, 200 C, 98 B, 303, 288; D6/347, 387, 386, 385, 382; 297/273

[56] References Cited

U.S. PATENT DOCUMENTS

| | | | |
|---|---|---|---|
| D. 86,334 | 2/1932 | Reuter | D6/347 X |
| 430,616 | 6/1890 | Brewer | 5/127 X |
| 443,544 | 12/1890 | Rohrman | 5/129 |
| 478,450 | 7/1892 | Meek | 5/129 X |
| 518,547 | 4/1894 | Keller | 5/120 X |
| 614,566 | 11/1898 | Meadows | 5/129 X |
| 659,487 | 10/1900 | McMurdy | 5/127 X |
| 749,731 | 1/1904 | Hall | 5/129 X |
| 797,011 | 8/1905 | Mosier | 5/238 |
| 937,258 | 10/1909 | McBride | 5/129 X |
| 957,644 | 5/1910 | Berger | 5/128 X |
| 1,372,219 | 3/1921 | Dieckmann | 5/127 X |
| 1,375,212 | 4/1921 | Crone | 5/303 X |
| 1,444,726 | 2/1923 | Broyles | 5/104 X |
| 1,540,540 | 6/1925 | Camm et al. | 5/129 X |
| 1,783,848 | 12/1930 | Lillibridge | 5/129 |
| 1,795,202 | 3/1931 | Dillingham | 5/129 |
| 3,879,774 | 4/1975 | Glasser et al. | 5/288 X |
| 4,125,912 | 11/1978 | Courter | 5/288 X |

FOREIGN PATENT DOCUMENTS

| | | | |
|---|---|---|---|
| 598182 | 12/1925 | France | 5/303 |
| 1396420 | 3/1965 | France | 5/303 |
| 586533 | 4/1977 | Switzerland | 5/200 R |
| 378671 | 8/1932 | United Kingdom | 5/200 R |

*Primary Examiner*—Alexander Grosz
*Assistant Examiner*—Carl M. DeFranco, Jr.

[57] ABSTRACT

The invention described in the technical disclosure is: a lightweight, mobile assembleable, free-standing, supporting structure and assembleable bed frame used to create a swinging or suspended bed. The invention is comprised of four, padded and covered, assembleable, stable upright structural stands being longitudinally and transversally interconnected with structural members whereon an assembleable, multi-functional, bed framework is suspended by flexible means thereof from the upper ends of the upright structural stands to swing freely therefrom in any and varying direction. A box spring and mattress is then placed in the assembleable bed frame thus accomplishing the object of the invention disclosed herein.

12 Claims, 17 Drawing Figures

13
4
14
20
24
42
38
19
21
22
27
31
37
55
36
35
41
12
14
23
13
25
32
26
34
45
1
2
3
4
5
6
7
8
10
11
18
53

3
20
33
19
12
10
45
1
2
3
4
6
7
8
11
18
53

51
8
53
7
30
11
18
2
5
4
6
14
32
58
13
10
9
28
12

18
23
25
39
47
30
57
38
31
26
59
34
56
29

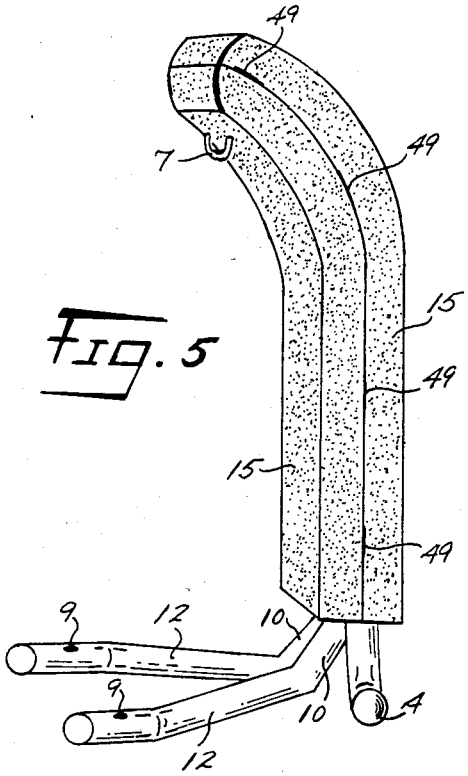
FIG. 5
FIG. 6
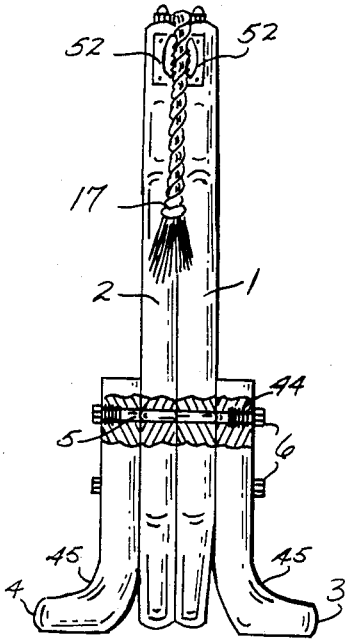
FIG. 7
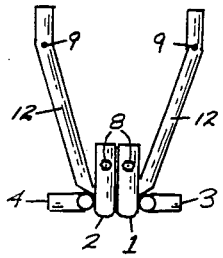
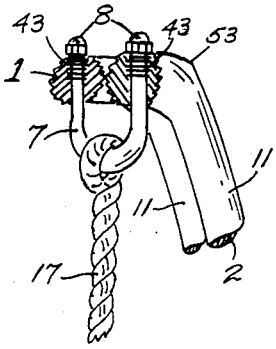
FIG. 8
FIG. 9
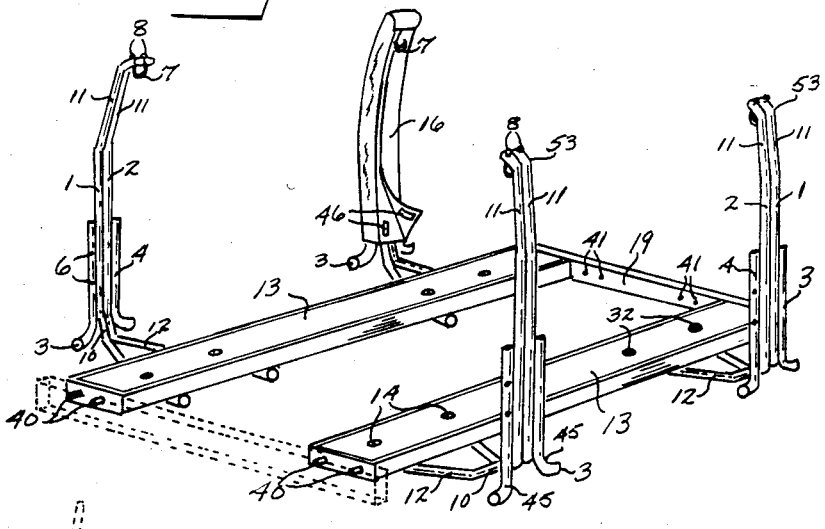
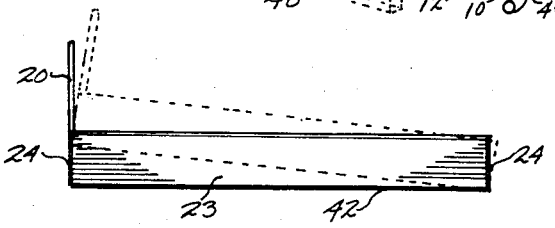
FIG. 10
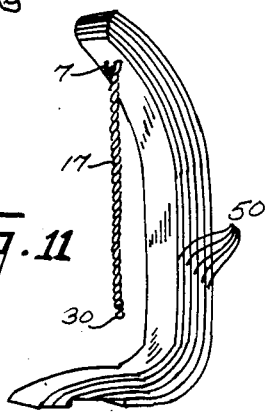
FIG. 11

Fig. 12
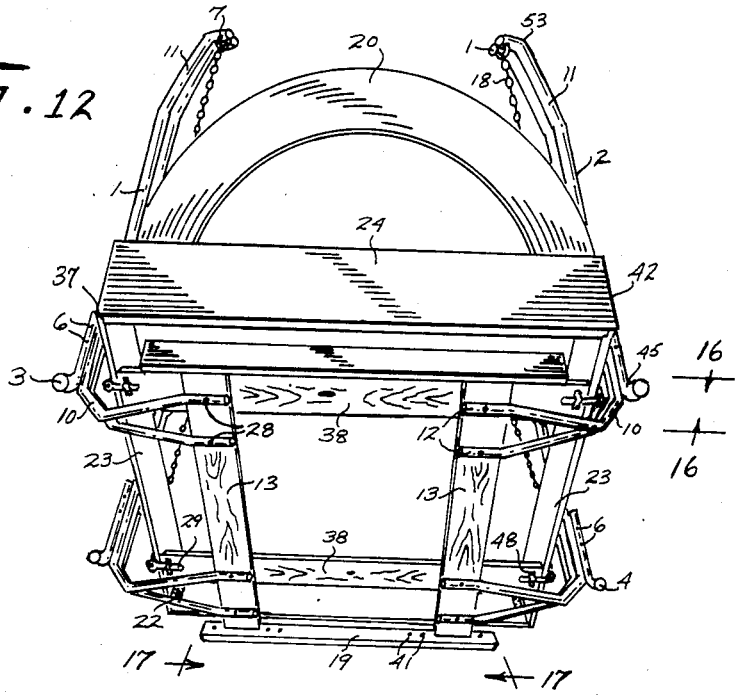
Fig. 13
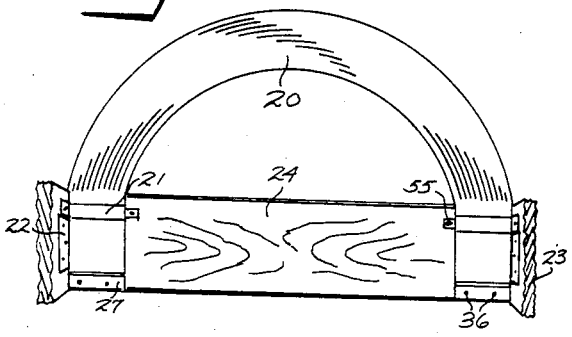
Fig. 14
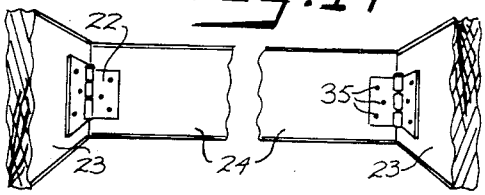
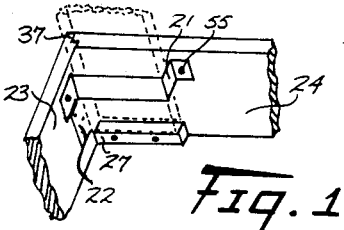
Fig. 15
Fig. 16
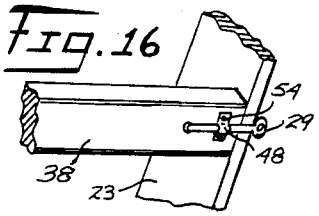
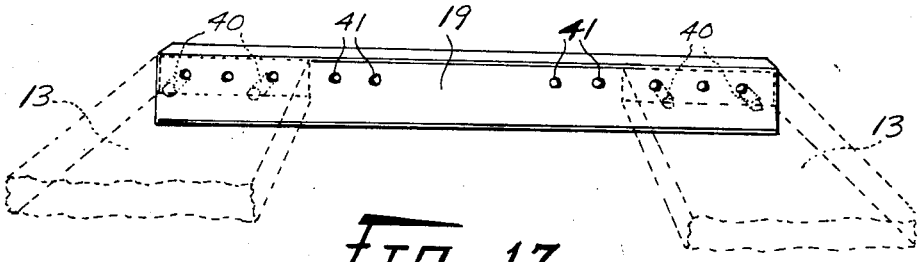
Fig. 17

ASSEMBLEABLE, FREE-STANDING, BED SUSPENSION APPARATUS

BACKGROUND OF THE INVENTION

This invention relates generally to hammocks and swings where up until now there has been a need to have the possibility of having a suspended bed without the mechanical problems associated with it. People have always enjoyed swinging on hammocks and the like but have not had a structural method or device available to them that was functionally and aesthetically appealing in all respects. The methods of application and devised structures of the past have all been, either bulky or of heavy weight construction necessitating them to be suspended from permanent objects of some sort or, of such manufacture as to lack efficiency and ease of facility in one respect or another. Ridge pole methods of application presented problems of their own, inherent in their design, as will be apparent when viewed in light of the invention I will disclose herein.

As a result of my own desire to have a suspended bed that was not only functional, but one that overcame the past problems of having to locate ceiling beams and the like necessary for the application of such, it became obvious to me that a free-standing, structural support system would be the only definitive solution to the problem. It was clear, that in order to accomplish this result, there would have to be invented a design and article of manufacture strong and rigid in construction yet flexible in application and compact in size so as not to be overpowering in dimension. It should also be aesthetically pleasing to the eye as well as the senses. Thusly, I have created a new, unique, and novel, structural apparatus for suspending a bed which incorporates the use of four lightweight, assembleable, individually stable stands interconnected by two longitudinally applied structural members, with two transversally adjustable connecting structural members attached therewith. Furthermore, I created a unique bed frame assembly that is very lightweight in construction as well as being functionally capable of supporting heavy weight. This bed frame, at the same time,has the ability to swing freely as if suspended in mid-air when attached to the supporting structure. Together, these inventions provide a more than efficient and adequate means of suspending a box spring and mattress when placed therein.

The free-standing structure, bed frame, and method of application are further enhanced by improvements I implemented to make the invention as a whole safer to use via application of foam padding to the assembleable upright stands. I also covered the stands and padding with fabric covers making the invention appealing to touch, see, and experience. Mbreover, I discovered a usefulness appertaining to this invention that has therapeutic value as an offering. The bed frame can be elevated at either the foot or head side and is a useful application when used by people with certain medical conditions as well as being a comfort factor thereof. Therefore, I present and disclose this invention and the attributes related therewith.

SUMMARY OF THE INVENTION

The purpose and main objective of this invention is to provide an assembleable, free-standing, lightweight, and stable structural system to which an assembleable bed frame can be suspended therefrom, wherein a box spring and mattress can be contained thereby creating an extremely pleasurable way of sleeping and or relaxing.

The apparatus of this invention includes four, assembleable, upright stands bent in such a manner as to provide a stable base for each stand whereby said stands are attached in sets of two with longitudinally affixed structural members for the purpose of adding stability thereto. These units are then set in a rectangular arrangement whereby transversally connected cross members unify these base units. An assembleable bed frame is then attached by flexible means therewith to the upper inwardly bent portions of the upright stands to be suspended therefrom so as to swing freely in any and varying direction. A box spring and mattress is placed within the assembled bed frame thus providing a means of suspending a bed to be used as desired.

Another objective of this invention is to provide a way of suspending a bed by eliminating the mechanical problems associated with accomplishing such. The methods used in the past have always required connections to permanent structures, such as ceiling beams, but this invention eliminates this and other problems.

Further, this invention is very mobile, being of lightweight construction, and can be easily assembled or disassembled and moved from room to room almost at will.

Moreover, this invention provides an aesthetically pleasing conceptual configuration that is not only pleasing to the senses but is functionally safeguarded by means of padding and covering placed upon components of the structure.

The assembleable bed frame can also be elevated at either end adding comfort as well as therapeutic value and also said bed frame can be detached and used in a conventional manner as well as having the ability to be suspended from a permanent structure if so desired.

Other features and advantages will become apparent upon consideration of the following detailed description and several accompanying drawings wherein the characters referenced will designate corresponding parts in the views.

BRIEF DESCRIPTION OF THE DRAWINGS

FIG 5 is a side perspective view showing an assembled stand encased in foam rubber;

FIG. 6 is a rear view of an assembled stand showing a bed frame elevating device attached and sectional view of the bolt assemblies;

FIG. 7 is a top view of an assembled stand;

FIG. 8 is an enlarged front perspective sectional view showing only the top of one assembled stand to illustrate the flexibe means connection assembly with an optional flexible means attached;

FIG. 9 is a front perspective view of the assembled support structure and assembly with one stand covered to illustrate the cover arrangement;

FIG. 10 is a side view of the bed frame and elevated possibility;

FIG. 11 is a side perspective view showing another embodiment of an assembled stand with optional flexible means attached;

FIG. 12 is a rear bottom oblique perspective view of the assembled bed frame suspended from the structural supporting system;

FIG. 13 is a front view taken generally along line 13—13 in FIG. 1 to further illustrate the headboard assembly;

FIG. 14 is a transverse sectional view taken generally along line 14—14 in FIG. 1 showing the loose pin hinge arrangement in the bed frame corners;

FIG. 15 is an enlarged view of the headboard bracket configuration;

FIG. 16 is an enlarged view taken generally along line 16—16 in FIG. 12 to further illustrate the eye bolt stabilizing arrangement;

FIG. 17 is a view taken generally along line 17—17 in FIG. 12 showing the transverse cross member assembly; These figures along with the detailed description that follows will disclose specific embodiments of the invention; notwithstanding, it is necessary to understand that the inventive concept is not limited thereto since other forms of embodiment are evident.

DETAILED DESCRIPTION OF THE PREFERRED EMBODIMENTS

Figure 1:
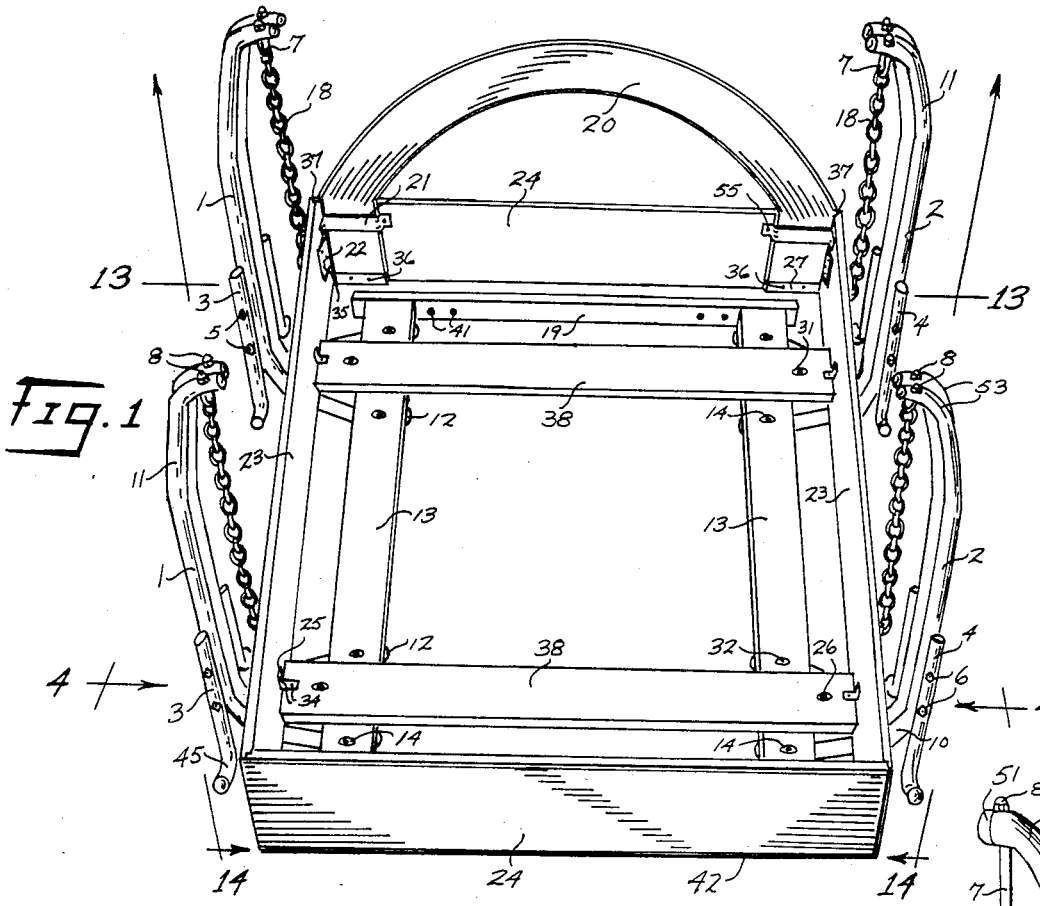
FIG. 1 is a frontal elevated perspective view of the assembled bed frame suspended from the structural supporting system.

Referring to FIG. 1, it will be seen generally that the construction of this embodiment involves the suspension of an assembleable bed frame 42, also referred to as a bed frame 42, by means 18 thereof, which can also be called chain 18, from four, assembleable, upright structural stands 1,2,3,4, which can also be called stands 1,2,3,4, which are connected by longitudinally attached base connecting structural members 13 and transversally attached base connecting cross members 19 that create a stable rectangular support structure from which the bed frame 42 is able to swing freely in any and varying direction. Wherein bedding, consisting generally of a box spring and mattress, not shown, is placed, hence, the result becoming an assembleable free-standing, structural, bed suspending apparatus.

The longer upright structural members 1,2 and the shorter stabilizing structural members 3,4 shown in FIGS. 1, 2, 6, 7, 9, and 12, are made with pipe bending equipment from 1" diameter solid aluminum bar but this can vary. The upright structural members 1,2 were made using 6 foot lengths for each. Referring to FIG. 9, the upper portion 11 is bent on an inward plane with a slightly curved or bent upper end portion 53 which provides a more level surface for which to attach a flexible means connector 7. From the upper portion 11, the shafts of the stand 1,2 extend downward and straightly for at least 24 inches to where the lower portion 10 is bent inwardly and at an angle so as to form a stable base 12 that extends under the 2"×6"×6' wooden base connecting structural members 13. The angulation of the shafts of stands 1,2 forming the base 12 is best illustrated in FIG. 7. The best overall height of the stands 1,2,3,4, is approximately 40" but can vary to preference.

Figure 3:
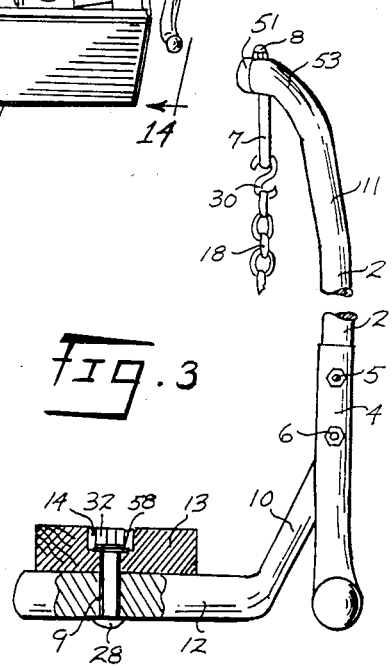
FIG. 3 is a sectional view taken generally along line 3—3 in FIG. 2 showing only the right front stand to illustrate the attachment of the base connecting structural members with the assembled stands and an alternate method of flexible means connection.

Referring to FIG. 3, ⅜" diameter holes 9 are drilled in the bases 12 and correspond with ⅜" diameter countersunken holes 14 drilled in the 2"×6"×6' base connecting structural members 13. FIG. 8 further shows that ¼" diameter holes 43 are drilled at the top end areas of each of the upright structural members 1,2 to accomodate a flexible means connector 7, which can also be called "U" bolt 7, which is ¼" diameter ×3", said "U" bolt 7 being fastened with ¼" diameter cap nuts 8. The 5/16" diameter holes 44 of FIG. 6 are also drilled in stands 1,2 to accomodate a 5/16" diameter ×4½" double end threaded bolt 5 that will be fastened with 5/16" diameter hex nuts 6 when the structural stand members 1,2,3,4 are assembled. The shorter stabilizing members 3,4, are approximately 18" in length and have only one 90° bend 45 located near the bottom ends of the shorter stabilizing structural members 3,4. The 5/16" diameter holes 44 are also drilled in said stabilizing members 3,4 and correspond with the holes 44 drilled in the longer upright structural members 1,2. Assembly of the stands 1,2,3,4 is accomplished by aligning all holes 44 and inserting a 4½"×5/16" diameter double end threaded bolt 5 at two locations, shown in FIG. 6, and fastened securely with 5/16" diameter hex nuts 6. These assembled stands 1,2,3,4 are very stable in and of themselves but to add further structural stability 2"×6"×6' wooden base connecting structural members 13 are attached to the assembled stands 1,2,3,4, longitudinally, in sets of two and secured with 3"×⅜" diameter carriage bolts 28, ⅜" diameter washers 58, and ⅜" diameter hex nuts 32, shown in FIG. 3.

Referring to FIG. 9, the assembled stands 1,2,3,4 are positioned side by side in sets of two and at a distance apart, approximately 48", so as to allow comfortable entry between the stands 1,2,3,4. FIG. 12 shows the stands 1,2,3,4 are also positioned so as to be aligned with the eye bolts 29 that are attached to the bed frame slat support cross members 38, said slat support cross members 38 assembly shown in FIG. 4. Also in FIG. 9, it can be readily seen that two assembled sets of stands 1,2,3,4 and their longitudinally attached 2"×6"×6' base connecting structural members 13 are positioned opposite and facing each other in a rectangular arrangement at a distance apart which will coincide with the size of the assembleable bed frame 42, not shown, to be suspended therefrom. The 2"×3"×4' wooden, transversally attached, adjustable, base connecting cross members 19 are held in place by use of dowel pins 40, said adjustable base connecting cross members 19 being arranged and set in accordance with the size bed frame 42, not shown, being accomodated.

Figure 2:
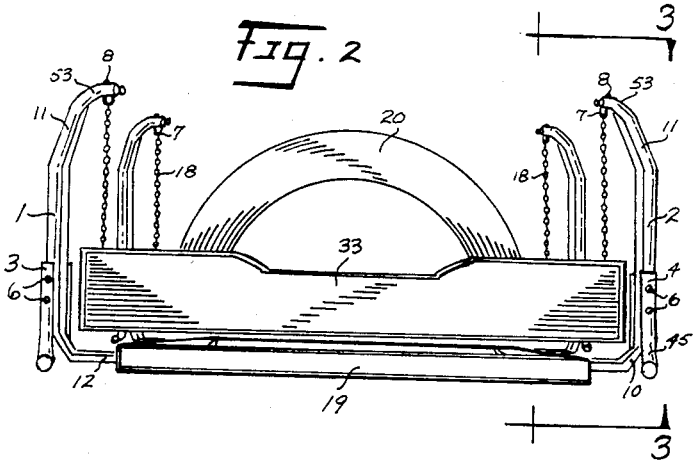
FIG. 2 is a front perspective view with the bed frame shown in another embodiment.

In FIG. 17, the ⅜" diameter holes 41 shown are spaced approximately 1½" apart and drilled to a depth of ¾". The ⅜" diameter holes 41 are aligned to correspond with the ⅜" diameter dowel pins 40 of equal spacing set in the ends of the 2"×6"×6' base connecting structural members 13. These 2"×3"×4' adjustable base connecting cross members 19 also have aesthetic value in that they help conceal the structural support system they are fastened to and is best illustrated in FIG. 2. Further shown in FIG. 2 is another embodiment of the shorter frame end sides 33 designated as such because of the design variance.

The structural support system that is created from the arrangement of the component parts shown in FIG. 9 is such that considerable weight can be supported when applied to this structure as a whole. Not only is this system functionally stable but it is of lightweight construction and extremely mobile, thereby creating a usefulness novel in its overall functionally.

To enhance the aesthetics and safety features of the support structure, and more specifically, the assembled stands 1,2,3,4, FIG. 5 shows that dense foam rubber 15 can be cut and formed so as to surround the stands 1,2,3,4, said foam rubber 15 being held in place with double-sided tape 49. The stand 1,2, 3,4 of FIG. 5 can then be covered with fabric covers 16, shown in FIG. 9 applied only to one of the stands 1,2,3,4, said fabric covers 16 being attached by using vel-cro fasteners 46. These vel-cro fasteners 46 are located along the inner seams of the fabric covers 16 where their placement will be most efficient. The utility of the foam rubber 15 and fabric covers 16 arrangement is apparent and is employed to create a softer appearance and safer quality to the invention as a whole.

FIG. 11 illustrates another embodiment of the assembleable stands 1,2,3,4. In this method of manufacture, laminated wood 50 is bent to the formation desired and should be essentially and substantially formed as shown to be as functional as possible. The flexible means connector 7 can be affixed in like manner as previously disclosed whereby an alternate flexible means 17, which can also be called ½" nylon rope 17, is attached thereto. If flexible means 17 is used in correlation with this invention it should be noted that it can be dyed any and various colors with dyes, "RIT" being one that works well.

The assembleable bed frame 42 of FIG. 1 is comprised of two 1"×12" wooden longer frame sides 23 being interset with two 1"×12" wooden shorter frame end sides 24 all having rabbet cut corners 37,thus creating the interset arrangement of the corners. The lengths of the longer frame sides 23 and shorter frame end sides 24, are cut so that when assembled will allow a clearance of 1½" all around the box spring and mattress, not shown, that it will contain enabling great facility in applying bed clothing, not shown, to the bed. The loose pin hinges 22 are fastened in place with wood screws 35 at all inside corners of the assembleable bed frame 42 as shown in FIG. 14.

Figure 4:
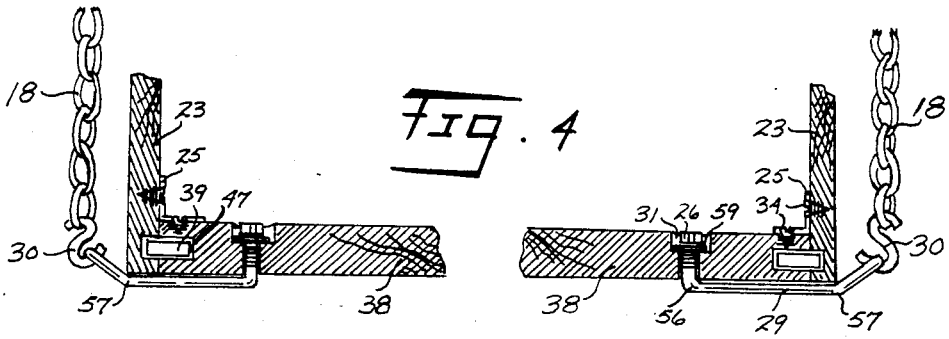
FIG. 4 is a transverse cross-sectional view taken generally along line 4—4 in FIG. 1 showing the slat support and eye bolt assemblies.

Referring to FIG. 4 the bed frame slat support cross members 38 are attached to the longer frame sides 23 by use of dowel pins 39. These 2"×6" slat support cross members 38 will also vary in length according to the box spring and mattress, not shown, to be accomodated. The slat support cross members 38 are positioned approximately 14" on center from the shorter frame end sides 24 and at a position level with the bottom edge of the longer frame sides 23 and are attached with dowel pins 39 so as to be of easy assembly and disassembly. The ⅜" diameter holes 47 are drilled in the ends of the 2"×6" bed frame slat support cross members 38 and at the corresponding positions of such in the longer frame sides 23 to receive said dowel pins 39. Four other ⅜" diameter holes 31 are countersunken and drilled 3" from the ends of the slat support cross members 38 and centered to allow a ⅜" diameter ×6" eye bolts 29, bent at a 90° angle 56 1¼" from the threaded end of the eye bolts 29 and also bent upward at a 45° angle 57 where the eye of the eye bolts 29 begin, said eyebolts 29 to be applied and attached securely with ⅜" diameter hex nuts 26 and ⅜" diameter washers 59. This eye bolt 29 assembly is used for the connection of a flexible means 18 therewith through use of ⅜" diameter ×2" "S" hooks 30. The purpose of bending the eye bolts 29 at a 45° angle 57 at the eye end is to help minimize the movement of the eye bolts 29 when in use and to keep the "S" hook connectors 30 situated in place so they do not hit against the surfaces of the longer frame sides 23 thereby marring them when the bed frame 42 is swinging. FIG. 16 also shows how cable brackets 48 are applied to the shafts of the eye bolts 29 to help hold them in place and where the cable brackets 48 are fastened to the slat support cross members 38 with wood screws 54. Further, the eye bolts 29, bent in such fashion when applied and tightened securely, also keeps the longer frame sides 23 held snugly in place with the 2"×6" slat support cross members 38 construction. Additionally, "L" brackets 25, shown in FIG. 4, are affixed to the surfaces of the longer frame sides 23 and the 2"×6" slat support cross members 38 with wood screws 34 for more rigidity in the overall connection.

A detachable headboard 20, shown in FIG. 13,is another feature of this assembleable bed frame 42. This is accomplished by attaching headboard brackets 21 to one of the shorter frame end sides 24 with wood screws 55. The headboard brackets 21 are manufactured of metal and bent as shown in FIG. 15. FIG. 13 further shows wooden headboard stop blocks 27, approximately 6" in length by 1" in width, are fastened to the selected shorter frame end side 24 with wood screws 36. The purpose of these headboard stop blocks 27 is to keep the detachable headboard 20 from dropping lower than a desirable distance when set in the headboard brackets 21. The detachable headboard 20 is made of five pieces of 1"×12"×18" wood stock, cut angularly, dowel pinned, and glued together, then cut in the desired design.

Once all the components of this invention have been assembled, the flexible means 18 are attached to the "U" bolts 7 by one of two ways. The flexible means 18 can be linked onto the "U" bolt 7 and then "U" bolt 7 applied through holes 43 of FIG. 8 and fastened with cap nuts 8; or "S" hooks 30 of FIG. 3 can be used to connect the flexible means 18 to the "U" bolts 7. The assembleable bed frame 42 can then be connected to the chain 18 with "S" hooks 30 and eye bolts 29 at all four locations of the bed frame 42. The distance between the assembled bed frame 42 and the stands 1,2,3,4 when suspended therefrom is approximately 6" at all locations. This distance is formed by arranging the structural support system accordingly. The height of the bed frame 42 can be elevated at either end simply by placing the "S" hooks 30 the number of links desired higher up in the chains 18. FIG. 10 illustrates an elevational possibility of bed frame 42 minus the support structure. Referring to FIG. 6, a cam cleat 52 can be attached to the stands and used with a ½" nylon rope 17 as an alternate method of suspension. With this method, the rope 17 is pulled and the bed frame 42 raises and lowers as desired. The cam cleat 52 locks in place when the rope is released. The flexible means 17 of FIG. 11, which is ½" nylon rope 17 formed in a loop, can be twisted tighter thereby shortening the length of the ½" nylon rope 17 which can then be reconnected by use of the "S" hooks 30 thereby raising the bed frame 42 at the desired locations.

Freeze caps 51 shown in FIG. 3 having a 1" inside diameter can be placed on the ends of all stands 1,2,3,4 ends for decoration as well as finishing said ends. The stands 1,2,3,4 can also be painted or powder coated to improve the appearance and quality. All wooden components 23,24,20,13,19,38 can be finished as desired by painting, staining, or lacquering.

At this point, the assembleable bed frame 42 of FIG. 1 having been suspended from the support structure will swing freely in any and varying directions. A box spring and mattress, not shown, is then set in the assembled bed frame 42 whereupon the accomplishment of the disclosed invention is derived.

I claim:

1. An assembleable, free-standing, bed suspension apparatus for suspending a swinging bed frame therefrom, comprising:

a rectangularly-arranged support system including four assembleable, free-standing, upright stands, each of said upright stands comprising a vertical post portion, a lower horizontally-extending base portion integrally-connected to a lower end of said vertical post portion, and an upper horizontally-extending portion integrally-connected to an upper end of said vertical post portion;

a rectangularly-shaped bed frame including two longitudinally-extending side boards connected together by two transversely-extending end boards;

one of said four upright stands positioned at each end of said longitudinally-extending side boards at each corner of said bed frame, said upright stands being two sets of two upright stands positioned side-by-side, each set facing each other on both sides of said bed frame so as to form said rectangularly-arranged support system for said frame;

said bed frame being suspended from each of said upper portions of said upright stands by flexible means attached thereto, said upper portions extending horizontally inward over said bed frame as a means of providing clearance for the swinging motion of said bed frame when attached by said flexible means therewith;

said lower base portion of each of said upright stands comprising two legs extending horizontally in a V-shape along and in contact with a floor surface underneath said bed frame as a means for providing a stable base for said upright stands;

L-shaped stabilizing leg members being attached to and on opposite sides of said vertical post portions of each of said upright stands, said stabilizing leg members comprising a vertical leg portion and an integrally-connected horizontal leg portion, said vertical leg portion being attached to said vertical post portion of said upright stand, and said horizontal leg portion extending along and in contact with said floor surface and being approximately perpendicular to said horizontal V-shaped legs of said upright stands;

first base connecting members extending longitudinally between and being attached at each end thereof to said lower horizontal base portions of each of said side-by-side upright stands as a means of providing stability thereto; and second base connecting adjustable crossmembers extending transversely between and being means of providing unity and further stability to said rectangulary-arranged support system.

2. The assembleable, free-standing, bed suspension apparatus as recited in claim 1 having said assembleable upright stands being made of rigid yet bendable material.

3. The assembleable, free-standing, bed suspension apparatus of claim 1 further having the uppermost end portions of said assembleable upright stands slightly bent as a means for providing a more level area for a flexible means connector to be attached thereto, whereby said flexible means is connected thereto as a means for suspending said assembleable bed frame therefrom.

4. The assembleable, free-standing, bed suspension apparatus as recited in claim 1 said assembleable upright stands being padded by surrounding said assembleable upright stands with dense foam rubber as a means of providing a safer construction and use thereof.

5. The assembleable, free-standing, bed suspension apparatus of claim 4 further having fabric covers placed over and around said assembleable upright stands as a means of providing decorative enhancement thereto, said fabric covers being optional.

6. The assembleable, free-standing, bed suspension apparatus as recited in claim 1 further having an assembleable bed frame comprising two longer frame sideboards and two shorter frame end boards intersect at all corner edges, all said corner edges having been rabbet cut and having loose pin hinges attached thereto, said loose pin hinges used as a means for providing easy assembly thereof.

7. The assembleable, free-standing, bed suspension apparatus of claim 6 having the lengths of said longer frame sides and said shorter frame ends cut so as to provide a $1\frac{1}{2}''$ clearance around the size of a box spring and mattress to be accomodated, said $1\frac{1}{2}''$ clearance to be used as means for providing great facility and applying bed clothes to said box spring and said mattress contained within said assembleable bed frame.

8. The assembleable, free-standing, bed suspension apparatus of claim 6 further having two slat support cross members attached by dowel pins to said longer frame sides at a location fourteen inches on center from the said shorter frame ends and positioned so as to be level with the bottom edges of said longer frame sides, said slat support cross members being used as a means of providing adequate support for the weight of the bedding and people to be placed thereon.

9. The assembleable, free-standing, bed suspension apparatus of claim 8 further having four eye oolts bent at a 90° angle $1\frac{1}{4}''$ from the threaded end side of said eye bolts and further having the eyes of said eye bolts bent at 45° angle upwardly, all said eye bolts being therewith attached to said slat support cross members, said eye bolts providing a flexible means connection thereto.

10. The assembleable, free-standing, bed suspension apparatus of claim 9 further having said flexible means connected to said eye bolts with an S-shaped hook attached thereto as a means of suspending said assembleable bed frame therefrom, whereby said assembleable bed frame can be elevated at either end of said assembleable bed frame by movement of said "S" hooks connection in said flexible means therewith to the desired elevation as a means for providing therapeutic value and comfort thereon.

11. The assembleable, free-standing, bed suspension apparatus of claim 6 further having four L-shaped brackets attached to the said slat support cross members as a means of providing added rigidity to said assembleable bed frame.

12. The assembleable, free-standing, bed suspension apparatus of claim 6 further having a detachable headboard assembly affixed to said assembleable bed frame as a means for providing decorative enhancement thereto.

* * * * *